United States Patent [19]

Brown

[11] 3,976,014

[45] Aug. 24, 1976

[54] MODULAR SHELVING APPARATUS

[76] Inventor: Clifford S. Brown, N76 W22300 Cherry Hill Road, Sussex, Wis. 53089

[22] Filed: Mar. 3, 1975

[21] Appl. No.: 554,852

[52] U.S. Cl. ..... 108/64; 52/648; 108/111; 108/143; 211/187; 312/198; 312/257 SK

[51] Int. Cl.[2] ..... A47B 47/02

[58] Field of Search ..... 108/64, 96, 107, 110, 108/111, 143; 211/148, 177, 182; 312/108, 111, 257 SK, 198; 52/648, 656, 758 B

[56] References Cited

UNITED STATES PATENTS

| | | | |
|---|---|---|---|
| 2,722,318 | 11/1955 | Brown | 211/148 X |
| 2,750,052 | 6/1956 | Brown et al. | 108/143 |
| 3,045,834 | 7/1962 | Seiz | 211/177 |
| 3,048,245 | 8/1962 | Shewell | 211/148 X |
| 3,254,774 | 6/1966 | Schild | 211/182 |
| 3,463,325 | 8/1969 | Zagotta et al. | 211/177 X |
| 3,846,944 | 11/1974 | Lambert | 211/148 |
| 3,892,189 | 7/1975 | Killam | 108/111 X |

FOREIGN PATENTS OR APPLICATIONS

| | | | |
|---|---|---|---|
| 211,501 | 3/1960 | Austria | 108/64 |
| 173,231 | 5/1922 | United Kingdom | 108/107 |
| 929,048 | 6/1963 | United Kingdom | 211/148 |

*Primary Examiner*—Ramon S. Britts
*Assistant Examiner*—William E. Lyddane
*Attorney, Agent, or Firm*—Henry C. Fuller

[57] ABSTRACT

Shelving stacks for a library or the like include lightweight pre-assembled free-standing modules which can be assembled as desired at the site. The modules are secured in assembly by rectangular top and bottom connecting frames and spaced by the frames so that the vertical frame members of the modules support slidable shelves within the modules and between the modules. The slidable shelves have a length greater than the depth of the modules. Rear wall ties and side frame ties are easily connected at the site to frame in an enclosure for the overhanging shelves and provide additional support for the modules as well as form an integrated assembly of the modules. The ties are provided in various lengths so that the shelving assembly can be arranged to provide the desired aisles and range pattern to fit the building floor plan.

7 Claims, 5 Drawing Figures

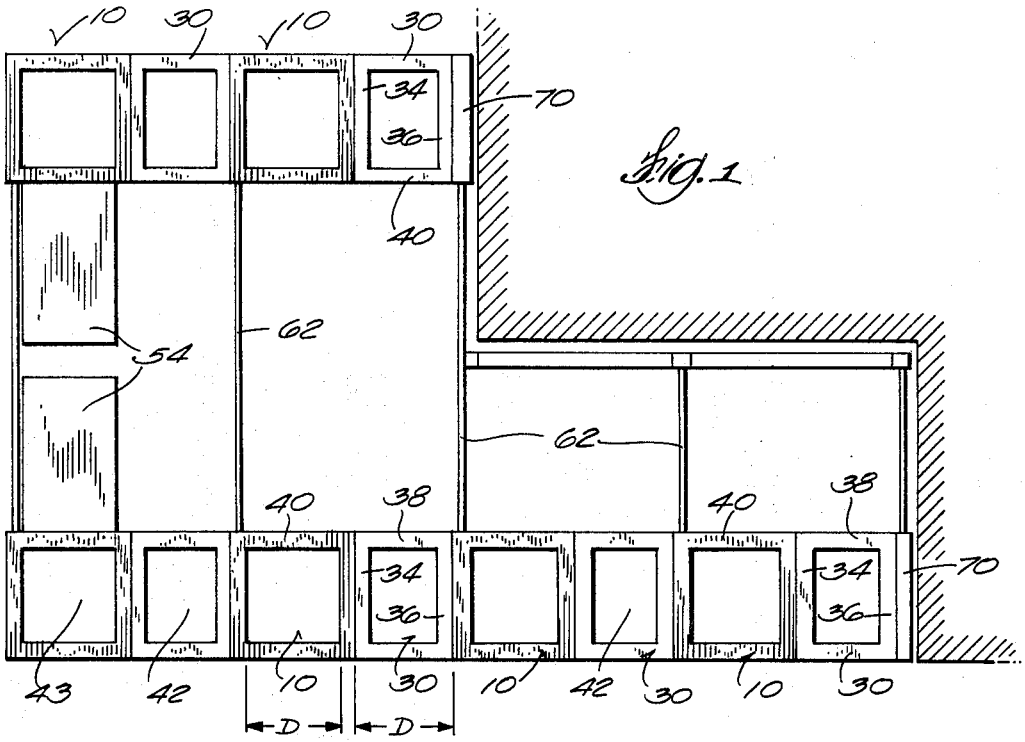
Fig. 1
Fig. 3
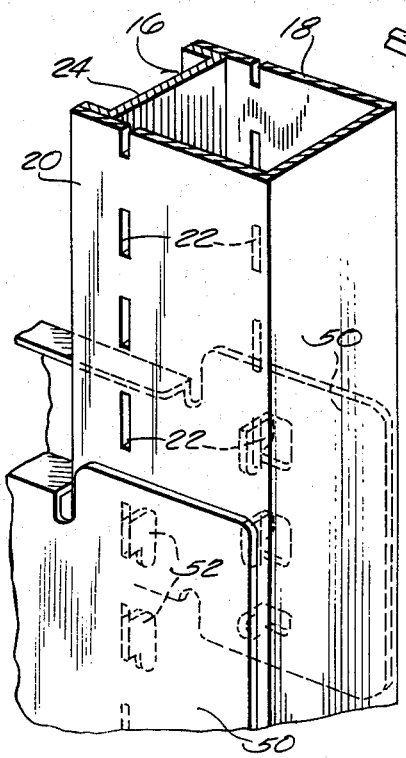
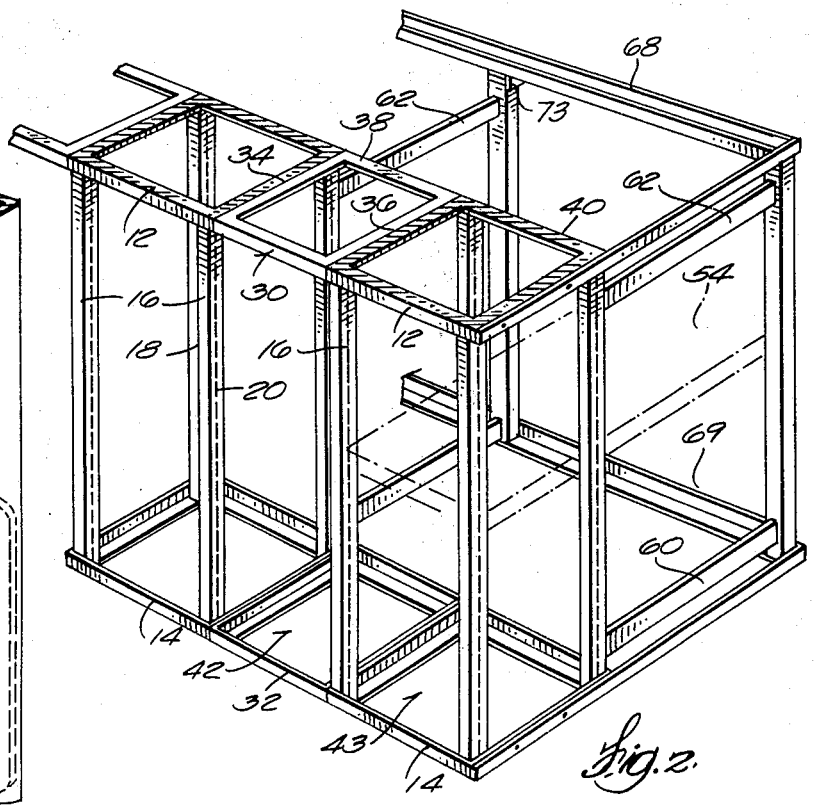
Fig. 2.

MODULAR SHELVING APPARATUS

SUMMARY OF INVENTION

To provide maximum use of available storage space the invention provides a shelving construction which is easily assembled at the site by the user to fit the floor plan of the room and to enable future modification of the range pattern to accommodate changing storage requirements. The pre-assembled modules are relatively small and lightweight and are easily manipulated by the user to change the range pattern from time to time. Ranges are easily assembled with varying depths to fit corners, posts, or jogs in the building wall pattern with side and rear end ties of different lengths.

The free-standing modules are connected by upper and lower rectangular frames which space the free-standing modules the appropriate distance to accommodate sliding shelves of the same width between the modules and within the modules. Rectangular end frames with four framing runs are employed to form an end unit in cooperation with the upper and lower spacing frames and rear and side framing ties and corner posts.

Further objects, advantages and features of the invention will become apparent from the following disclosure.

DESCRIPTION OF DRAWINGS

FIG. 1 is a schematic plan view of shelving ranges formed from interconnected module units in accordance with the invention.

FIG. 2 is an enlarged fragmentary perspective view showing the interconnected module units of the invention.

FIG. 3 is an enlarged fragmentary perspective view showing a vertical post of a module unit and showing shelf suspension members.

DESCRIPTION OF PREFERRED EMBODIMENT

Figure 4:
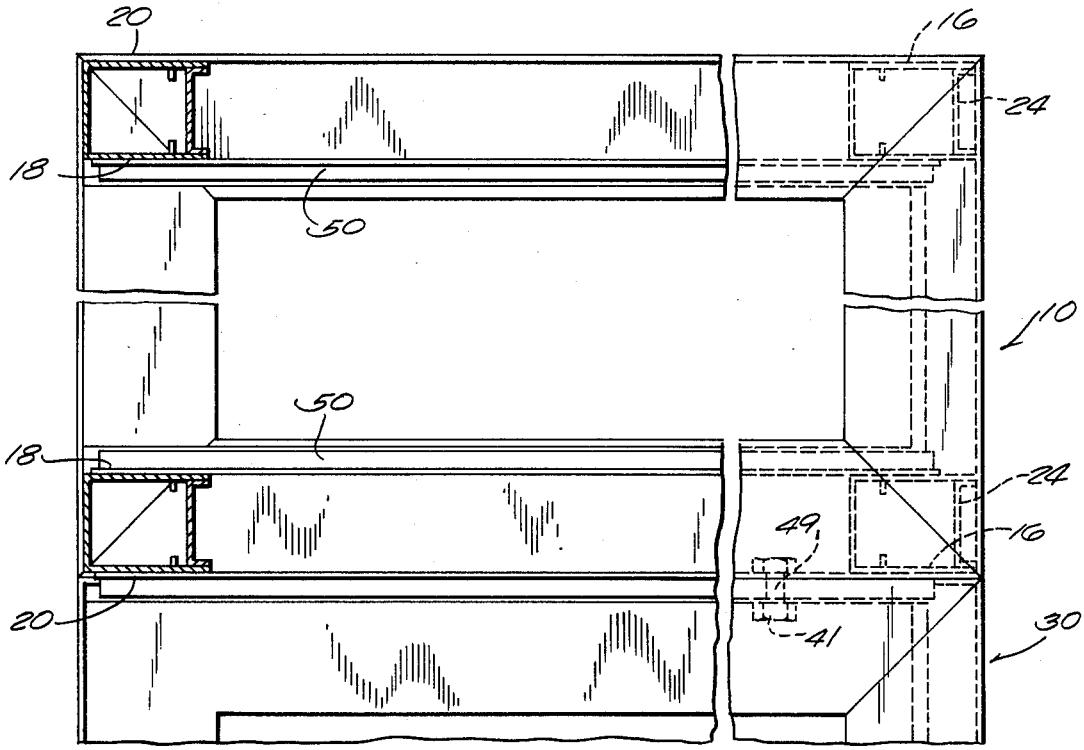
FIG. 4 is a plan view partially broken away of a module unit.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

In the drawings, FIG. 1 shows a plurality of free-standing modular units 10 which include (FIG. 2) first frames or top frames 12 and bottom frames 14 which are constructed of angle iron and which have joints which can be mitered. Each vertical post has an inner side 18 and an outer side 20. As shown in FIG. 3, the inner and outer sides or faces 18, 20 are provided with spaced slots 22 for purposes subsequently described.

The vertical posts 16 are formed from U-shaped channel members and rigidified by U-shaped channels 24 which fit between the sides 18, 20. The vertical posts 16 are welded to the top and bottom frames 12, 14 to form rectangular modular structures light in weight and free-standing. The units 10 are desirably pre-assembled by the manufacturer and shipped in the skeletonized form shown in FIG. 2 separate from the shelves.

In accordance with the invention, the units 10 are interconnected by second upper and lower frames 30, 32 which are rectangular in shape and which include side frame runs 34, 36 which have a depth equal to the depth of the first frames 12, 14. The width of the runs 38 is less than the width of the runs 40 of the frames 12, 14 as best shown in FIGS. 1 and 2. When assembled, the side runs 34, 36 of the second frames 30 abut the adjacent runs of the first frames 12, 14 and are secured thereto by bolts 41 which register in apertures 49. The second frames 30 space the free-standing units 10 so that the distance D between the inner sides 18 of the modules 10 are spaced an equal distance D between the outer sides of posts 16. Thus, the vertical posts 16 accept and support the identical shelving assemblies between the units 10 in space 42 as well as within the units 10 in space 43.

The shelf assemblies 54 are vertically adjustable and include shelf suspension members 50 which have hooks 52 which engage the slots 22. The details of the shelf assemblies form no part of the invention and accordingly, are not described in detail. The shelf assemblies 54 can be of the type shown in my previous U.S. Pat. No. 2,750,052 and have substantially greater depth (FIG. 1) than the depth of the units 10. The entire subject matter of U.S. Pat. No. 2,750,052 is incorporated herein by reference. Accordingly, the modular units 10 are relatively lightweight and compact in relationship to the size of the shelves and the storage capacity.

Figure 5:
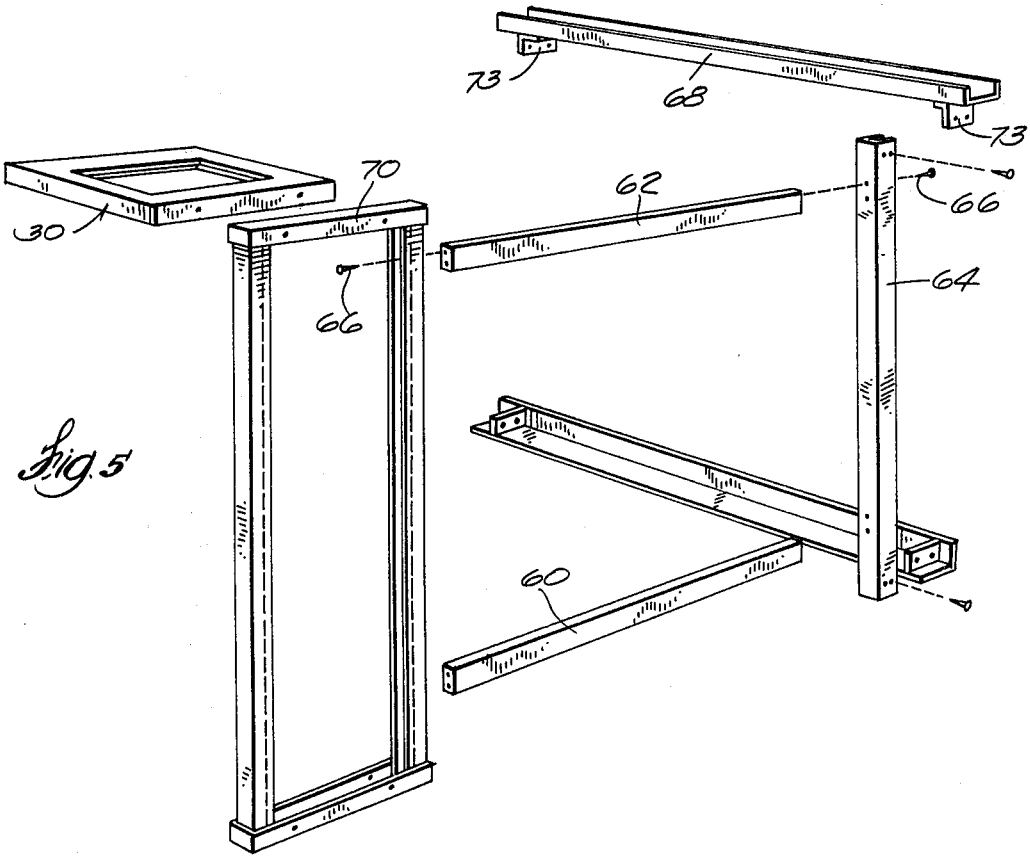
FIG. 5 is a perspective view of various framing components.

Support for the units 10 is provided by side and rear framing members (FIGS. 1, 5). The side members 60, 62 are connected to end posts 64 and the units 10 by bolts 66. The posts 64 are connected to upper and lower rear ties 68 and 69. The ties 68 are provided with brackets 73 which are connected by bolts to the corner posts 64 which have a construction similar to posts 16.

End frames 70 (FIG. 5) are also provided which have four runs at right angles and are employed as shown in FIG. 1 to terminate the end of a range where the last unit is formed from the second frames 30 and 32.

As shown in FIG. 1 the side ties 60, 62 are provided in different lengths for double or single faced ranges.

The use of lightweight free-standing units and the ease of assembly of these units enable the user to change the range pattern without assistance of the manufacturer when storage and space requirements change.

I claim:

1. A shelving construction comprising a plurality of preassembled free-standing units each of said units including first rectangular top and bottom frames having vertically extending side faces, vertical framing members having upper and lower ends connected to said first frames proximate each of the corners thereof and located inwardly of the external periphery of said first and second frames, each of said vertical framing members including a front face and two opposed side faces, the corresponding faces of pairs of said vertical framing members on one side of said rectangular frames being parrallel; a plurality of second rectangular top and bottom connecting frames, and connecting means for connecting said second frames between the side faces of said top and bottom frames of said free-standing units interconnecting and spacing said free-standing units a distance common to the distance between the parallel side faces of said pairs of vertical framing members which lie in a plane parallel to the direction in which said spacing is measured so that shelves of the same width will fit between the free-standing units and within the free-standing units and provide an integral assembly of a plurality of shelf receiving units.

2. A shelving construction in accordance with claim 1 including side frame ties, and rear cross ties of varying lengths and means for connecting said ties to said units to support said units to make an integrated structure of said units and enclose said shelves.

3. A shelving construction in accordance with claim 1 wherein said vertical framing members of said free-standing units have slots in said opposed faces to receive connecting hooks on sliding shelf assemblies.

4. A shelving construction in accordance with claim 1 including rectangular end frames having four framing runs defining a rectangle and means for connecting said end frames to said second top and bottom frames to form an end unit.

5. A shelving construction in accordance with claim 1 wherein said first and second frames are constructed of angularly related material with horizontal and vertical flange portions and said vertical framing members are welded to said first frames within said vertical flanges to form an integral structure and wherein said first and second frames are provided with registrable bolt apertures and bolts securing said first and second frames together.

6. A shelving construction in accordance with claim 5 wherein said second frames have four angularly related portions welded together.

7. A shelving construction as shown in claim 1 including sliding shelves supported between said opposed side faces of said vertical framing members, said shelving assemblies having a length greater than the depth of said units and a framework of tie members connected to said free-standing units forming a skeletonized frame enclosing the overhang of said shelving assemblies.

* * * * *